US006415556B1

(12) United States Patent
Silberman et al.

(10) Patent No.: US 6,415,556 B1
(45) Date of Patent: Jul. 9, 2002

(54) TRANSPORT MECHANISM FOR LARGE STRUCTURES SUCH AS RETRACTABLE STADIUM ROOVES

(75) Inventors: Cyril J. Silberman, Minnetonka; M. David Sadinsky, Minneapolis; Barton L. Riberich, Brooklyn Park; Cheuk A. Cheng, New Brigton; Dick Eide, Minneapolis; Lennart Nielsen, Edina; Michael James Becker, Brooklyn Center; Timothy John Kline, Minnetonka; Michael R. Riberich, Dayton; Jennifer Ann McLeish, Fridley, all of MN (US)

(73) Assignee: Uni-Systems, Inc., Minneapolis, MN (US)

( * ) Notice: Subject to any disclaimer, the term of this patent is extended or adjusted under 35 U.S.C. 154(b) by 0 days.

(21) Appl. No.: 09/609,728

(22) Filed: Jul. 3, 2000

(51) Int. Cl.[7] ..... E04B 1/346; E04B 7/16
(52) U.S. Cl. ..... 52/66; 52/6; 52/64; 52/83
(58) Field of Search ..... 52/66, 6, 64, 83

(56) References Cited

U.S. PATENT DOCUMENTS

| | | | |
|---|---|---|---|
| 2,052,217 | A | 8/1936 | Sibour et al. |
| 2,603,171 | A | 7/1952 | Smith |
| 2,642,162 | A | 6/1953 | Tobias |
| 3,009,211 | A | 11/1961 | Hansen et al. |
| 3,213,571 | A | 10/1965 | Olson |
| 3,288,158 | A | 11/1966 | Gugliotta |
| 3,534,511 | A | 10/1970 | Cappella |
| 3,608,252 | A | 9/1971 | Bisson |
| 3,766,691 | A | 10/1973 | Ray |
| 4,175,361 | A | 11/1979 | Kumode |
| 4,257,199 | A | 3/1981 | Kuboyama |
| 4,348,833 | A | 9/1982 | Nagoya |
| 4,587,775 | A | 5/1986 | Lewis et al. |
| 4,616,451 | A | 10/1986 | Glick |
| 4,676,033 | A | 6/1987 | Allen et al. |
| 4,682,449 | A | 7/1987 | Berger |
| 4,706,419 | A | 11/1987 | Adachi et al. |
| 4,716,691 | A | 1/1988 | Allen et al. |
| 4,727,688 | A | 3/1988 | Kida et al. |

(List continued on next page.)

FOREIGN PATENT DOCUMENTS

| | | | |
|---|---|---|---|
| JP | 2-217539 | A | 8/1990 |
| JP | 2-269237 | A | 11/1990 |
| JP | 3-87434 | A | 4/1991 |
| JP | 3-115632 | A | 5/1991 |
| JP | 4-323446 | A | 11/1992 |
| NL | 8006712 | | 7/1982 |

*Primary Examiner*—Carl D. Friedman
*Assistant Examiner*—Chi Q. Nguyen
(74) *Attorney, Agent, or Firm*—Knoble & Yosida LLC

(57) ABSTRACT

An edifice such as a sports stadium is adapted for open use during good weather as well as for covered use during poor weather by having at least one movable roof member. Each movable roof member includes a transport mechanism that is constructed and arranged to permit the roof member to move in a predetermined path with respect to the underlying structure of the edifice. The transport mechanism includes structure for supporting both ends of the roof member, which bridges an otherwise open area of the edifice. In order to permit some flexure and movement of the roof member with respect to the underlying edifice, as will inevitably occur as a result of natural forces such as winds, orientation structure is provided for maintaining the transport mechanism in a predetermined orientation while simultaneously permitting a limited amount of movement of the roof member in a direction that is nonparallel to the predetermined path of movement. The orientation structure has been found to be most effective when it is provided at but one end of the roof member.

29 Claims, 7 Drawing Sheets

U.S. PATENT DOCUMENTS 4,738,057 A 4/1988 Logan
4,751,800 A 6/1988 Kida et al.
4,802,314 A 2/1989 Schildger, Jr.
4,831,792 A * 5/1989 Berger ..... 52/66
4,833,837 A 5/1989 Bonneau
4,920,707 A 5/1990 Moskaliuk et al.
4,936,060 A 6/1990 Gelinas et al.
4,942,698 A 7/1990 Kumagai
4,995,203 A 2/1991 Brisbin et al.
5,007,214 A 4/1991 Itami et al.
5,010,695 A 4/1991 Schildge, Jr.
5,027,565 A 7/1991 Sugizaki
5,035,093 A 7/1991 Parazader et al.
5,058,332 A 10/1991 Masuyama et al.
5,062,243 A 11/1991 Kumagai
5,063,730 A 11/1991 Muramoto et al.
5,103,600 A 4/1992 Geiger et al.
5,117,594 A 6/1992 Muramoto et al.
5,167,097 A 12/1992 Robbie et al.
5,203,125 A 4/1993 Sugizaki
5,257,481 A 11/1993 Reppas et al.
5,257,485 A 11/1993 Kawaguchi et al.
5,371,983 A 12/1994 Kawaguchi et al.
5,394,660 A 3/1995 Haris
5,653,066 A 8/1997 Schildge, Jr.
5,746,028 A 5/1998 DiBenedetto
5,778,603 A 7/1998 Reppas
5,896,708 A 4/1999 Doi et al.
6,082,053 A * 7/2000 Bischof et al. ..... 52/64

* cited by examiner

TRANSPORT MECHANISM FOR LARGE STRUCTURES SUCH AS RETRACTABLE STADIUM ROOVES

BACKGROUND OF THE INVENTION

1. Field of the Invention

This invention pertains, in general, to the field of retractable covers or roofs for large structures, such as athletic stadiums. More specifically, the invention relates to an improved transport mechanism for such a structure that is more compact, reliable, stable, mechanically simple and inexpensive to construct than comparable mechanisms heretofore known.

2. Description of the Related Technology

It is common these days for athletic stadiums to be constructed with retractable roofs, because this type of construction offers spectators the pleasure of being outdoors on pleasant days, while providing shelter when necessary against extreme temperatures and inclement weather conditions. In addition, retractable roof construction permits the use of natural grass in a stadium, which is very important to most athletes.

A number of factors must be taken into account in the design of a stadium that has a retractable roof. For instance, the forces created by the exertion of natural forces such as wind, rain snow and even earthquakes on such a large structure can be enormous, and the roof, the underlying stadium structure and the transport mechanism that is used to guide and move the roof between its retracted and operational positions must be engineered to withstand the worst possible confluence of such forces. In addition, for reasons that are both aesthetic and practical, it is desirable to make the structural elements of the roof and the transport mechanism to be as unobtrusive and as space-efficient as possible. It is desirable to make the roof structure and the transport mechanism to be as simple and maintenance-free as possible, and to be constructed so as to be able to open and close as quickly as possible.

Many cities in the United States and elsewhere are now using or building retractable roofed stadiums. The designs of the various stadiums are quite different, but there are a number of deficiencies that seem to be common to all of the designs that have been implemented thus far. For example, the transport mechanisms in most of the stadiums tend to be quite large, being as much as twenty to thirty feet in height. The transport mechanisms further tend to include a relatively small number of very large, heavily loaded wheels and bearings, and a small number of very large motors or actuators to drive the roof between the retracted and operational positions. The small number of large wheels exert very large concentrated loads onto the support structure, which requires the support structure to be heavily reinforced, adding to the cost and complexity of the stadium as a whole. The roof and transport mechanisms in existing designs further tend to be relatively heavy and inflexible, and often experience alignment problems during movement. While many of these problems have been eliminated through the efforts of Uni-Systems, Inc., as is disclosed in U.S. patent application Ser. No. 09/140,718, the entire disclosure of which is hereby incorporated as if set forth fully herein, additional improvements are possible and are sought after by Uni-Systems, Inc. and others.

Environmental forces that are constantly at work on these massive structures exacerbate the alignment problems. For example, temperature differentials will cause different areas of the roof members, transport mechanisms and the underlying structures to expand and contract unpredictably. Settling of the foundation and other portions of the stadium will occur over time, adding to the alignment problems. Most importantly, winds acting on the roof structure can cause a large section of roof to move, often by several inches. While reinforcement can reduce the amount of such movement, it will add to the weight and expense of the structure.

A need exists for an improved design for a stadium that has a retractable roof and transport mechanism that is compact, lightweight and mechanically simple, and that is capable of maintaining its stability and alignment during normal use and in extreme conditions more capably than comparable mechanisms heretofore known.

SUMMARY OF THE INVENTION

Accordingly, it is an object of the invention to provide an improved design for a stadium that has a retractable roof and transport mechanism that is compact, lightweight and mechanically simple, and that is capable of maintaining its stability and alignment during normal use and in extreme conditions more capably than comparable mechanisms heretofore known.

In order to achieve the above and other objects of the invention, a system according to a first aspect of the invention for supporting a large structural member for stable movement with respect to an underlying structure includes a transport mechanism that is constructed and arranged to permit the large structural member to move in a predetermined path with respect to the underlying structure; and orientation structure for maintaining the transport mechanism in a predetermined orientation while simultaneously permitting a limited amount of movement of the large structural member in a direction that is nonparallel to the predetermined path According to a second aspect of the invention, an edifice having a movable roof member includes an underlying structure; a roof member; a transport mechanism that is constructed and arranged to permit the roof member to move in a predetermined path with respect to the underlying structure; and orientation structure for maintaining the transport mechanism in a predetermined orientation while simultaneously permitting a limited amount of movement of the roof member in a direction that is nonparallel to said predetermined path.

A stadium according to a third aspect of the invention and having a movable roof member includes a main stadium edifice having a first roof support area, a second roof support area, and an open area therebetween; a first transport mechanism mounted on said first roof support area, said first transport mechanism being constructed and arranged to permit movement along a first path; a second transport mechanism mounted on said second roof support area, said second transport mechanism being constructed and arranged to permit movement along a second path that is substantially parallel to said first path; a roof member supported at first and second locations, respectively by said first and second transport mechanisms; and orientation structure for permitting a limited amount of movement of at least a portion of said roof member in a direction that is nonparallel to said first and second paths without affecting either of said transport mechanisms.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
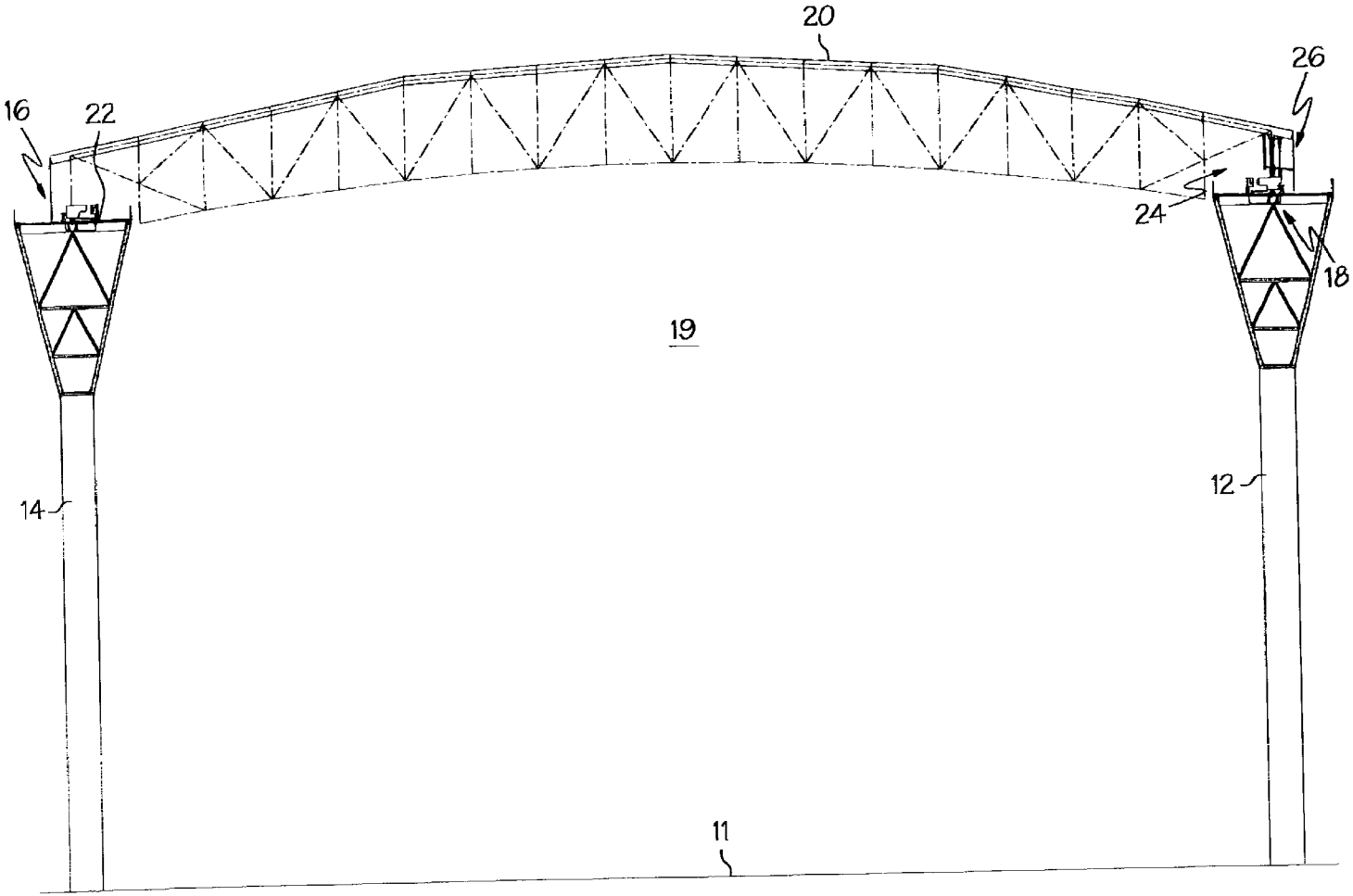
FIG. 1 is a perspective view of a system that is constructed according to a first preferred embodiment of the invention.

Referring now to the drawings, wherein like reference numerals designate corresponding structure throughout the views, and referring in particular to FIG. 1, a system for supporting a large structural member for stable movement with respect to an underlying structure is in the preferred embodiment a system 10 that includes a stadium 12 having a foundation 14 that is supported by the ground 11. Stadium 12 includes a main stadium edifice having a first roof support area 16, a second roof support area 18 and an open area 19 positioned therebetween, which is the area in which activities and or seating will occur in the stadium 12. As may further be seen in FIG. 1, system 10 includes a plurality of roof members 20, each of which is supported at a first location by a first transport mechanism 22 that is constructed and arranged to permit movement along a first path, and at a second location by a second transport mechanism 24, which is constructed and arranged to permit movement along a second path that is substantially parallel to the first path. According to one important aspect of the invention that will be discussed in greater detailed below, an orientation mechanism or system 26 is provided for permitting a limited amount of movement of at least a portion of the roof member 20 in a direction that is nonparallel to the first and second paths without affecting either of the transport mechanisms 22, 24. Roof members 20 are of a mass that is no less than five tons, and may be as much as 100 tons, or even heavier.

Figure 2:
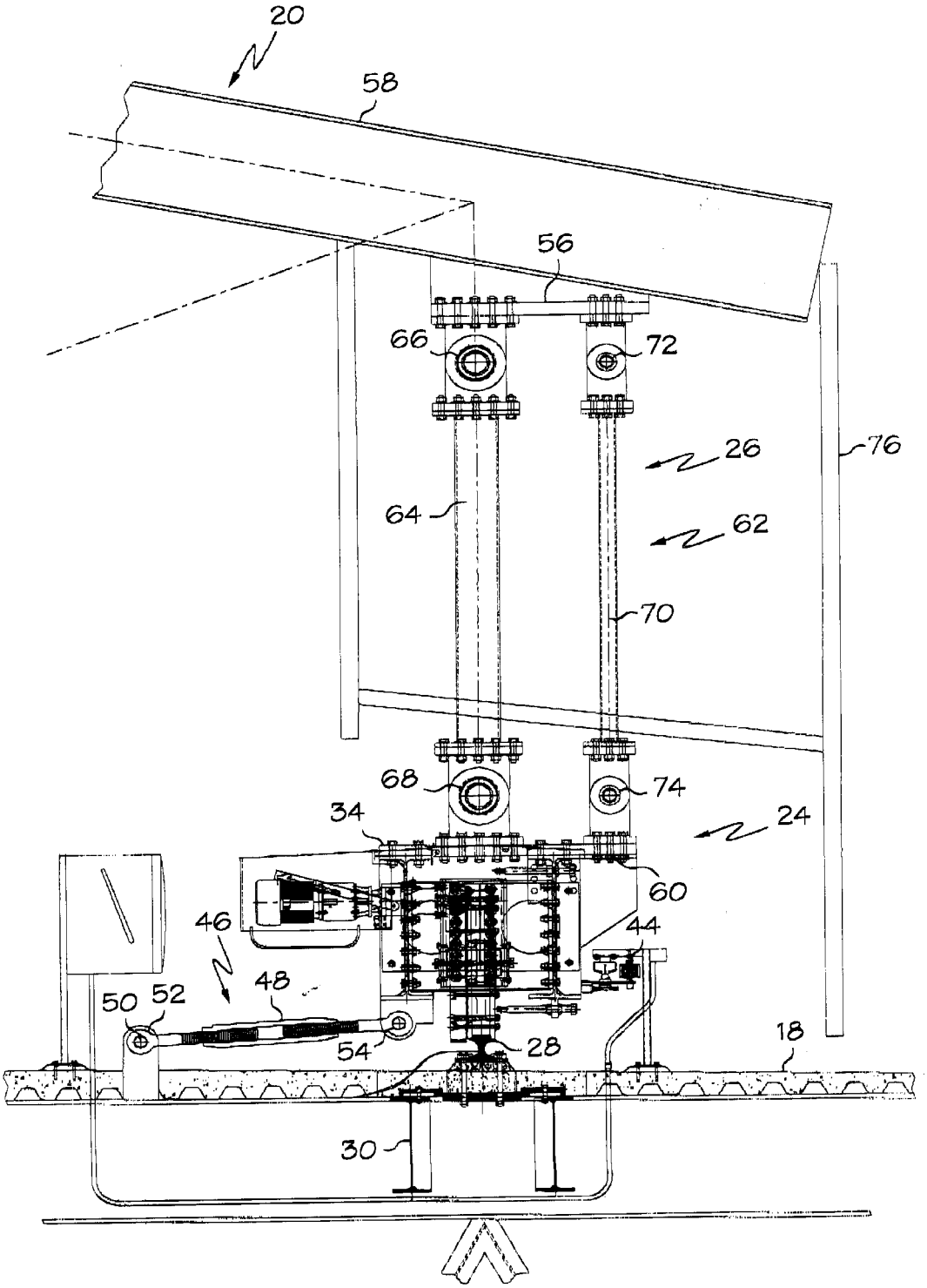
FIG. 2 is a fragmentary cross-sectional view of a portion of the system shown in FIG. 1, shown in a first operational position.
Figure 5:
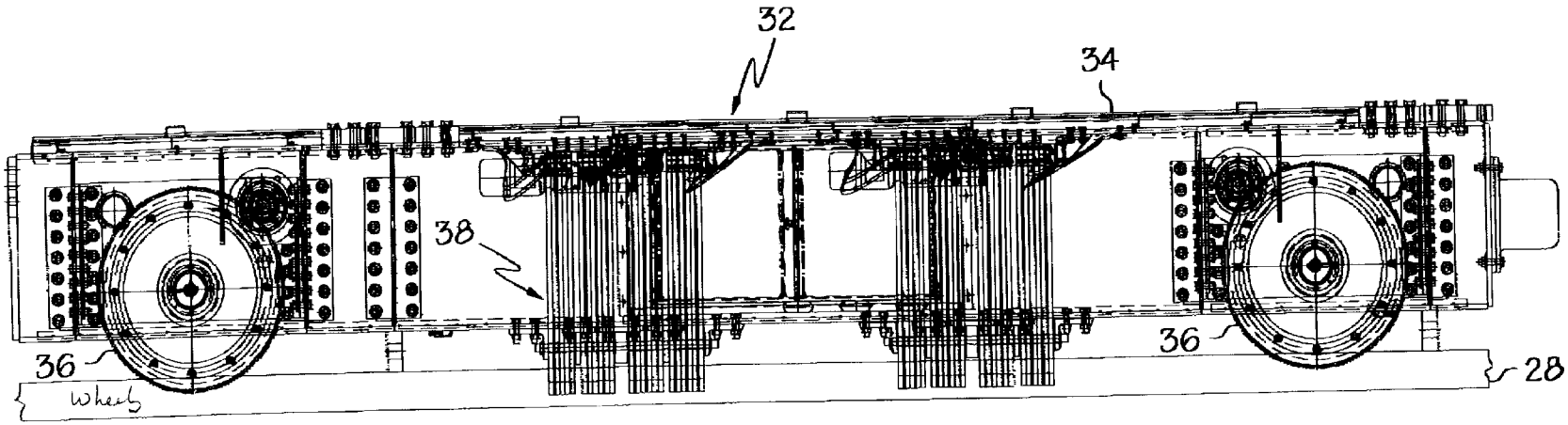
FIG. 5 is a fragmentary cross-sectional view depicting another portion of the system shown in FIG. 1.

Looking to FIG. 2, which is a fragmentary cross-sectional view depicting the second transport mechanism 24 and the orientation mechanism 26, it will be seen that the second transport mechanism 24 is preferably embodied so as to include a rail member 28, which is mounted on top of the second roof support area 18 and is securely anchored into the foundation 14 of the underlying stadium structure 12 by anchoring structure 30 to the extent that is necessary to bear the aggregate weight of the roof members 20, and to resist uplift. As may best be seen in FIGS. 2 and 5, the second transport mechanism 24 further includes a trolley 32 that includes a pair of wheels 36 that are constructed and arranged to ride on the rail 28. Trolley 32 includes a sturdy housing or outer frame 34, for reasons that will become apparent in the description that is provided below. In addition, trolley 32 includes a clamping mechanism 38, which is selectively actuatable to clamp against the rail 28 and thereby secure the trolley 32 to the rail 28. Clamping mechanism 38 thereby constitutes structure for resisting uplifting of the roof member 20 as a result of wind dynamics or other factors. Clamping mechanism 38 will be discussed in greater detail below in reference to FIG. 6.

Figure 7:
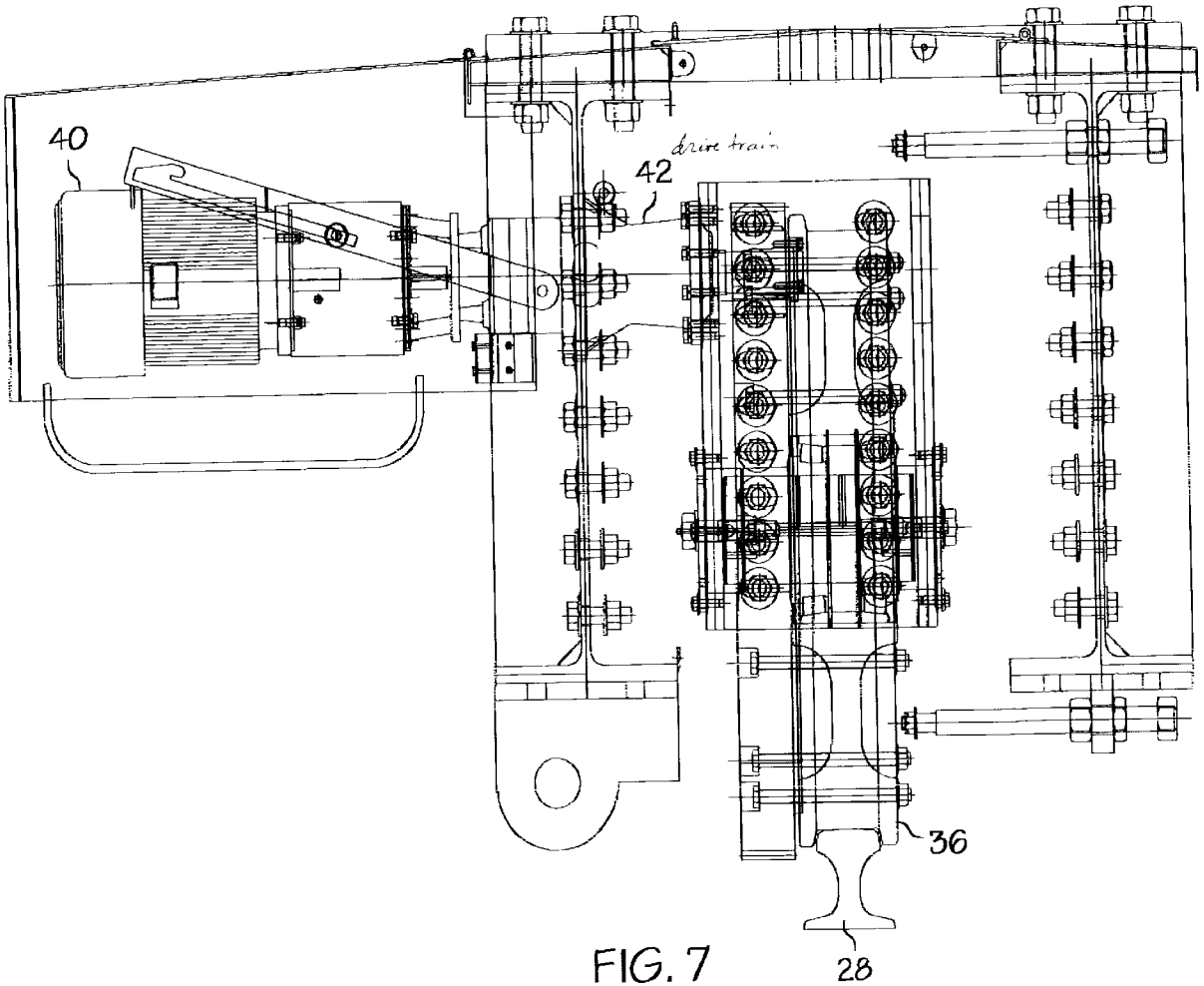
FIG. 7 is a fragmentary cross-sectional view depicting yet another portion of the system shown in FIG. 1.

Looking now to FIGS. 2 and 7, it will be seen that trolley 32 further includes for each wheel 36 a drive motor 40, which is preferably electric and which provides motive power to the respective wheel 36 via a drive train 42 that has appropriate reduction gearing. The drive motors 40 preferably derive power from a power supply rail 44 that is positioned in the second roof support area 18 and that is oriented so as to be generally parallel to the rail 28.

As is described above, clamping mechanism 36 is provided to give the system 10 the capability of resisting forces that will tend to lift the roof member 20 from the underlying structure, which is the stadium 12. This capability is supplemented by a plurality of emergency tie down mechanisms 46, one of which is illustrated in FIG. 2. As is shown in FIG. 2, the emergency tie down mechanisms 46 includes a turnbuckle mechanism 48 that is releasably securable to a lug 50 that is anchored into the second roof support area 18 by a releasable hinge mechanism 52. The turnbuckle mechanism 48 is further secured at a second end thereof to a connection point on the housing 34 of trolley 32 by a similar releasable hinge mechanism 54. It is anticipated that the emergency tie down mechanism will be utilized only in the event of a forecasted weather emergency, such as a hurricane.

Figure 3:
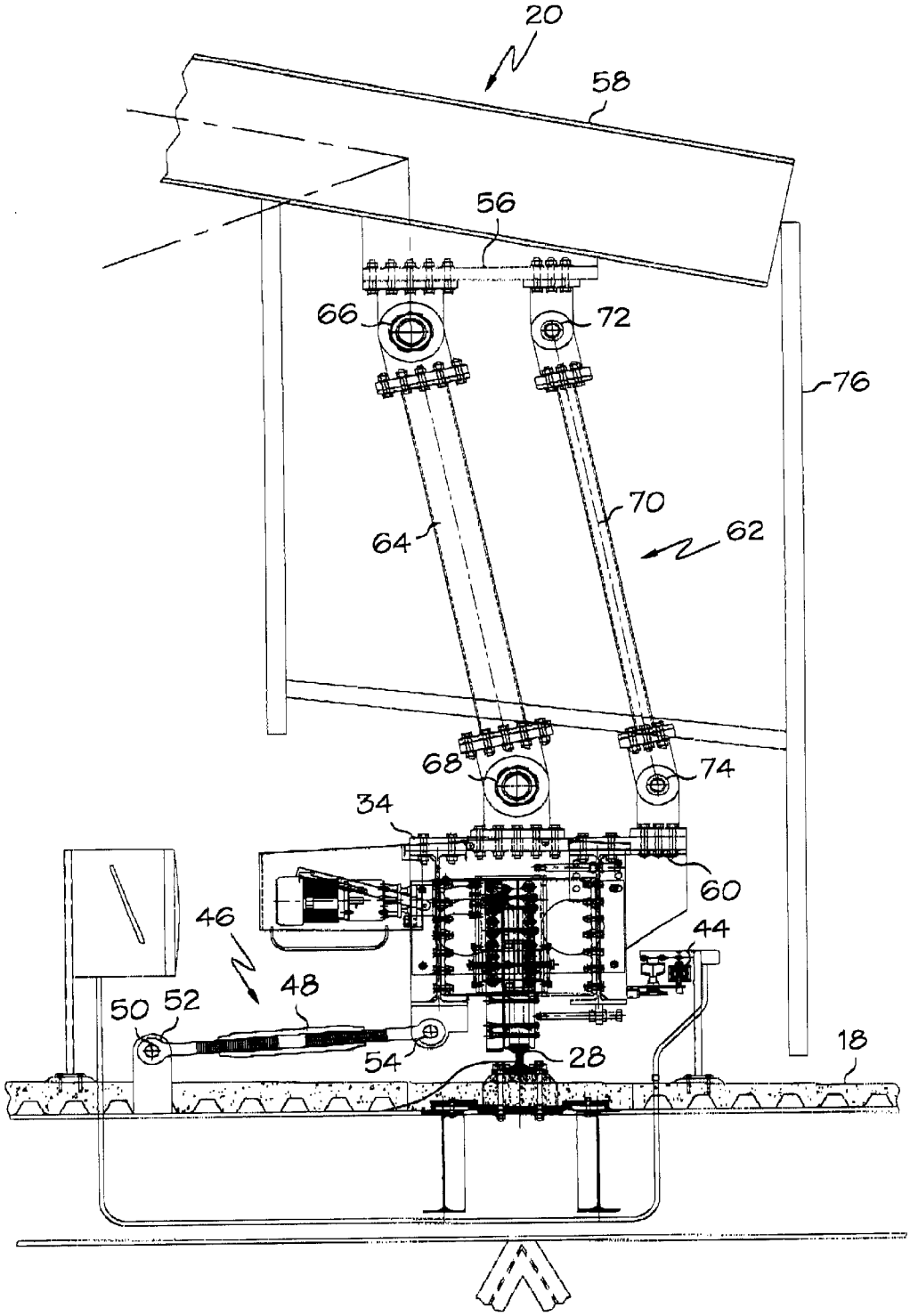
FIG. 3 is a fragmentary cross-sectional view of the portion of the system shown in FIG. 2, shown in a second operational position.

One important aspect of the invention is the orientation mechanism 26, which provides flexure to the overall system 10 that permits the system 10 to move in response to external forces, such as winds, without affecting the performance of the transport mechanisms 22, 24 or other components of the roof member 20 or the stadium 12. As is best shown in FIGS. 2 and 3, the orientation mechanism 26 is preferably embodied as a parallel bar linkage 62 and is most preferably constructed as a plurality of four bar linkages. Alternatively, the orientation mechanism 26 could be embodied as a single bar linkage that is fixed at a lower end and hinged at the higher end, although this is not the preferred embodiment. As may be seen in FIG. 2, roof member 20 includes a structural member 58 to which an upper mounting bracket 56 is secured. A lower mounting bracket 60 is likewise secured to an upper portion of the housing 34 of the trolley 32. The upper mounting bracket 56 includes a mounting surface that is roughly parallel to the mounting surface of the lower mounting bracket 60, as can be seen in FIG. 2. As long as these two mounting surfaces remain roughly parallel, the trolley 32 will remain substantially upright and will not tend to rotate with respect to the underlying rail 28. It is the function of the parallel bar linkage 62 to permit the roof member 20 to move from side to side, which in FIG. 2 would be from left to right, while maintaining the mounting brackets 56, 58 so that they will be substantially parallel thereby ensuring the stability of the trolley 32 relative to the rail 28. In the preferred embodiment that is depicted in the drawings, the parallel bar linkage 62 includes a primary link 64 that is connected to the upper mounting bracket 56 by means of a first hinge mechanism 66, and that is similarly connected to the lower mounting bracket 60 by means of a second hinge mechanism 68. Primary link 64 is designed to bear most of the weight of the roof member 20, and the hinge mechanisms 66, 68 are preferably embodied as self-aligning spherical bushings. The parallel bar linkage 62 further includes a secondary link 70 that is attached to the upper mounting bracket 56 by means of a first hinge mechanism 72 and that is similarly attached to the lower mounting bracket 60 by means of a second hinge mechanism 74. The links 64, 70 and the hinge mechanism is 66, 68, 72, 74 are bolted to each other and to the respective mounting brackets 56, 58 so as to be modular in construction, so that if one component needs to be replaced, it may be replaced with a standard, prefabricated product that is also compatible with the other parallel bar linkages 62 that are provided in the orientation mechanism 26.

The orientation mechanism 26 imbues flexibility into the system without increasing the possibility of system failure. The mechanism could also be used in conjunction with a rigid roof structure and a flexible underlying support.

In the most preferred embodiment, the second transport mechanism will include ten trolleys 32 which will be positioned adjacent to each other on the rail 28, and each trolley mechanism 32 will include two parallel linkages 62 of the type that are depicted in FIG. 2.

A cover panel 76 is preferably provided to extend between the roof member 20 and the upper surface of the second roof support area 18 to shelter the mechanism 24 and for aesthetic purposes.

Figure 4:
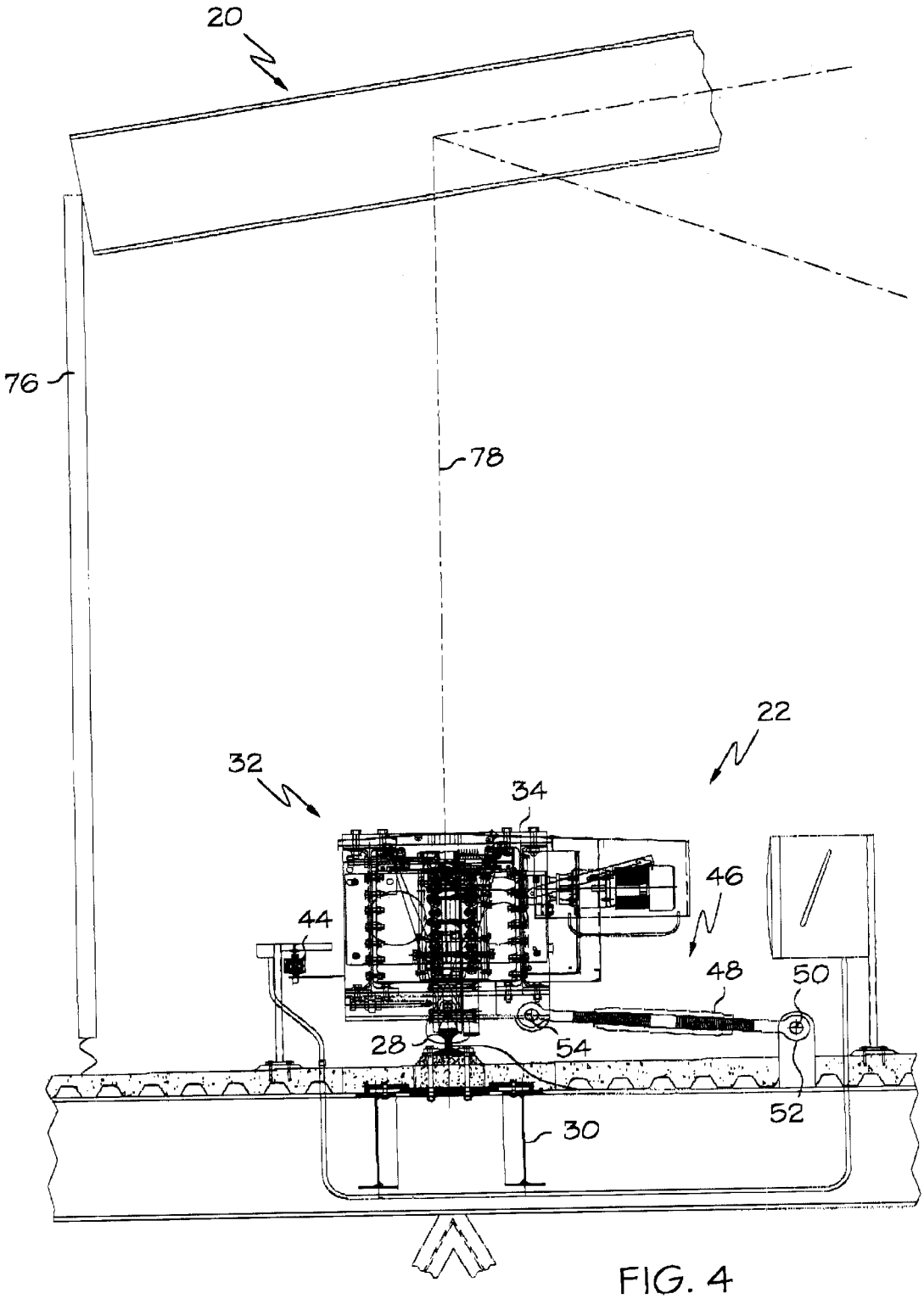
FIG. 4 is a fragmentary cross-sectional view of another portion of the system shown in FIG. 1.

FIG. 4 depicts the first roof support area 16 and the first transport mechanism 22. This area is substantially identical to, although symmetrically opposite from, the area of the second roof support area 18 and second transport mechanism 24 that has previously been described with reference to FIGS. 2 and 3, except that no orientation mechanism is provided, and, instead, there is a solid structural connection 78 between the roof member 20 and the housing 34 of the trolley mechanism 32. It has been found that the system 10 is the most stable when the orientation mechanism 26 is provided on but one end of the roof member 20.

Figure 6:
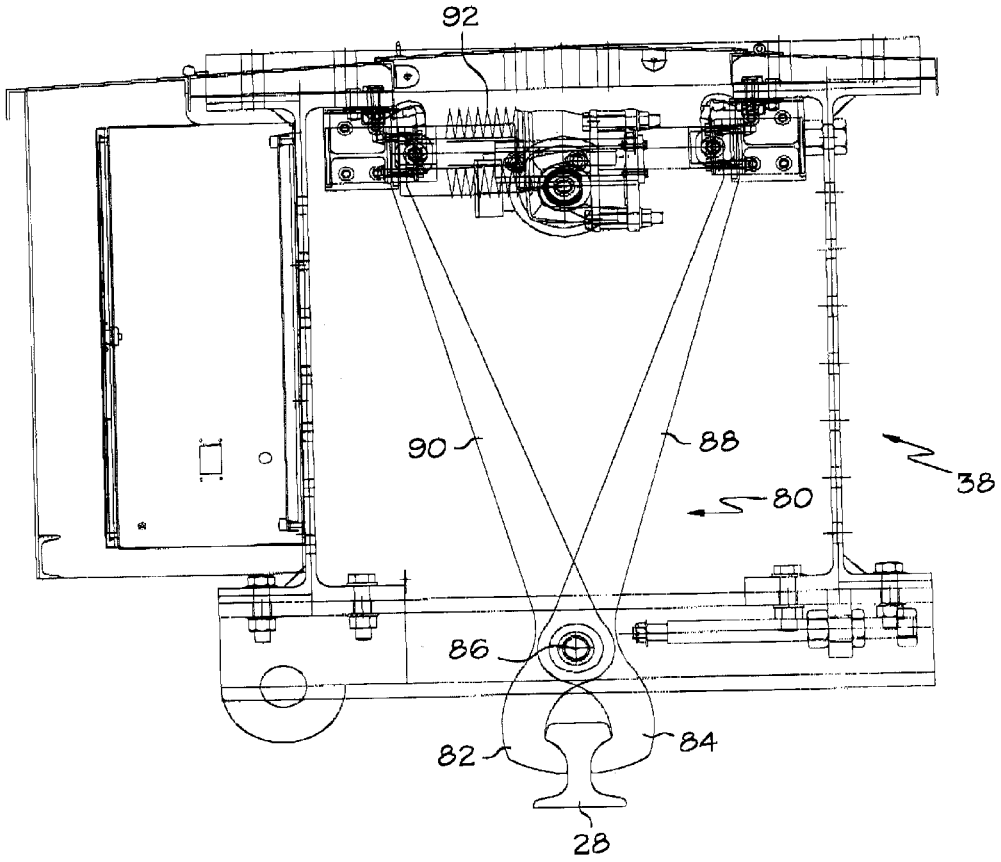
FIG. 6 is a fragmentary cross-sectional view depicting another portion of the system shown in FIG. 1.

Referring now to FIG. 6, the clamping mechanism 38 discussed above will now be described more completely. The clamping mechanism 38 includes a plurality of rail clamps 80, each of which includes a first clamp member 82 that is constructed and arranged to engage one side of an upper bead area of the rail 28, and a second clamp member 84, which is likewise constructed and arranged to engage the opposite side of the upper bead area of the rail 28. The two clamp members are connected by a hinge mechanism 86, and the first clamp member 82 is unitary with a first lever arm 88, while the second clamp member 84 is similarly unitary with a second lever arm 90. An actuation mechanism 92 is provided for engaging the distal ends of the lever arms 88, 90 and for moving those hands toward or away from each other. When the distal ends of the lever arms 88, 90 are pulled toward each other, the clamps 82, 84 will engage the upper bead of the rail 28, thereby securing the trolley 32 against upward movement as a result of wind forces that may act on the roof member 20. This clamping action will also secure the trolley mechanism 32 against travel motion along the direction of the rail 28.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A system for supporting a large structural member for stable movement with respect to an underlying structure, comprising:

a transport mechanism that is constructed and arranged to permit the large structural member to move in a predetermined path with respect to the underlying structure; and orientation means for maintaining the transport mechanism in a predetermined orientation while simultaneously permitting a limited amount of movement of the large structural member in a direction that is nonparallel to said predetermined path.

2. A system according to claim 1, wherein said transport mechanism comprises a rail that is secured to the underlying structure, said rail defining the predetermined path, and at least one trolley that is mounted to traverse said rail.

3. A system according to claim 2, wherein said orientation means comprises means for maintaining said trolley in a substantially fixed angular orientation with respect to said rail.

4. A system according to claim 3, wherein said orientation means comprises a parallel bar linkage.

5. A system according to claim 3, wherein said orientation means comprises a parallel bar linkage.

6. An edifice having a movable roof member, comprising:

an underlying structure;

a roof member;

a transport mechanism that is constructed and arranged to permit the roof member to move in a predetennined path with respect to the underlying structure; and orientation means for maintaining the transport mechanism in a predetermined orientation while simultaneously permitting a limited amount of movement of the roof member in a direction that is nonparallel to said predetermined path.

7. An edifice according to claim 6, wherein said transport mechanism comprises a rail that is secured to the underlying structure, said rail defining the predetermined path, and at least one trolley that is mounted to traverse said rail.

8. An edifice according to claim 7, wherein said orientation means comprises means for maintaining said trolley in a substantially fixed angular orientation with respect to said rail.

9. An edifice according to claim 8, wherein said orientation means comprises a parallel bar linkage.

10. An edifice according to claim 6, wherein said orientation means comprises a parallel bar linkage.

11. An edifice according to claim 10, wherein said parallel bar linkage comprises a primary link that assumes most of a gravity load that is borne by said parallel bar linkage, and at least one secondary link.

12. An edifice according to claim 10, wherein said parallel bar linkage includes at least one link that is of modular construction.

13. An edifice according to claim 6, further comprising means for resisting uplifting of said roof member as a result of wind dynamics.

14. An edifice according to claim 13, wherein said means for resisting uplifting of said roof member as a result of wind dynamics comprises means for releasably clamping an object that is secured to said underlying structure.

15. An edifice according to claim 14, wherein said means for releasably clamping an object that is secured to said underlying structure comprises means for clamping a rail member that is part of said transport mechanism.

16. An edifice according to claim 13, wherein said means for resisting uplifting of said roof member as a result of wind dynamics comprises emergency tie-down means that is secured prior to expected extreme weather conditions.

17. An edifice according to claim 6, wherein said roof member is supported at first and second ends thereof by first and second of said transport mechanisms, respectively, and wherein said orientation means is provided at only one of said first and second ends.

18. A stadium having a movable roof member, comprising:

a main stadium edifice having a first roof support area, a second roof support area, and an open area therebetween;

a first transport mechanism mounted on said first roof support area, said first transport mechanism being constructed and arranged to permit movement along a first path;

a second transport mechanism mounted on said second roof support area, said second transport mechanism being constructed and arranged to permit movement along a second path that is substantially parallel to said first path;

a roof member supported at first and second locations, respectively by said first and second transport mechanisms; and orientation means for permitting a limited amount of movement of at least a portion of said roof member in a direction that is nonparallel to said first and second paths without affecting either of said transport mechanisms.

19. A stadium according to claim 18, wherein at least one of said transport mechanisms comprises a rail that is secured to the underlying structure, said rail defining the predetermined path, and at least one trolley that is mounted to traverse said rail.

20. A stadium according to claim 19, wherein said orientation means comprises means for maintaining said trolley in a substantially fixed angular orientation with respect to said rail.

21. A stadium according to claim 20, wherein said orientation means comprises a parallel bar linkage.

22. A stadium according to claim 18, wherein said orientation means comprises a parallel bar linkage.

23. A stadium according to claim 22, wherein said parallel bar linkage comprises a primary link that assumes most of a gravity load that is borne by said parallel bar linkage, and at least one secondary link.

24. A stadium according to claim 22, wherein said parallel bar linkage includes at least one link that is of modular construction.

25. A stadium according to claim 18, further comprising means for resisting uplifting of said roof member as a result of wind dynamics.

26. A stadium according to claim 25, wherein said means for resisting uplifting of said roof member as a result of wind dynamics comprises means for releasably clamping an object that is secured to said main stadium.

27. A stadium according to claim 26, wherein said means for releasably clamping an object that is secured to said underlying structure comprises means for clamping a rail member that is part of said transport mechanism.

28. A stadium according to claim 25, wherein said means for resisting uplifting of said roof member as a result of wind dynamics comprises emergency tie-down means that is secured prior to expected extreme weather conditions.

29. A stadium according to claim 18, wherein said roof member is supported at first and second ends thereof by first and second of said transport mechanisms, respectively, and wherein said orientation means is provided at only one of said first and second ends.

* * * * *